US010362925B2

(12) United States Patent
Gerold

(10) Patent No.: US 10,362,925 B2
(45) Date of Patent: Jul. 30, 2019

(54) DOSING DEVICE FOR DISPENSING A WASHING AGENT IN A WASHING MACHINE, IN PARTICULAR A DISH WASHING MACHINE

(71) Applicant: BITRON S.p.A., Turin (IT)

(72) Inventor: Jans Gerold, Waldburg (DE)

(73) Assignee: BITRON S.P.A., Turin (IT)

( * ) Notice: Subject to any disclaimer, the term of this patent is extended or adjusted under 35 U.S.C. 154(b) by 50 days.

(21) Appl. No.: 15/672,669

(22) Filed: Aug. 9, 2017

(65) Prior Publication Data

US 2018/0042448 A1 Feb. 15, 2018

(30) Foreign Application Priority Data

Aug. 10, 2016 (IT) ..... 102016000084226

(51) Int. Cl.
*A47L 15/44* (2006.01)
*D06F 39/02* (2006.01)

(52) U.S. Cl.
CPC ..... *A47L 15/44* (2013.01); *A47L 15/4418* (2013.01); *A47L 15/4463* (2013.01); *D06F 39/024* (2013.01)

(58) Field of Classification Search
CPC ..... A47L 15/4418; A47L 15/4409; A47L 15/4463; A47L 15/4445; A47L 15/44;
(Continued)

(56) References Cited

U.S. PATENT DOCUMENTS 5,176,297 A * 1/1993 Mooney ..... A47L 15/4418 222/325
6,338,351 B1 1/2002 Schrott
(Continued)

FOREIGN PATENT DOCUMENTS

CN 1 973 752 A 6/2007
DE 197 20 820 A1 11/1998
(Continued)

OTHER PUBLICATIONS

Italian Written Opinion issued in IT201600084226 dated May 24, 2017.

(Continued)

*Primary Examiner* — David G Cormier
*Assistant Examiner* — Thomas Bucci
(74) *Attorney, Agent, or Firm* — Sughrue Mion, PLLC

(57) ABSTRACT

A dosing device includes an electrically controlled valve device driven at each operating cycle of the machine with a first short pulse for the actuation of another function and then with a subsequent second long pulse to put the dosing chamber in communication with the main chamber and then causing the dispensing of a dose of washing agent from the dosing chamber to the washing chamber. The valve device controls the communication between the intermediate chamber and the dosing chamber whereby the first impulse is able to put the intermediate chamber in communication with the dosing chamber for a short time, causing a partial discharge of the air bubble from the intermediate chamber to the dosing chamber and a corresponding increase in the amount of washing agent contained in the intermediate chamber, and the second impulse is adapted to put the intermediate chamber in communication with the dosing chamber for a longer time, adapted to allow the storage of a dose of washing agent in the dosing chamber and, after exhausting the second impulse, the dispensing of the dose of washing agent stored in the dosing chamber.

6 Claims, 5 Drawing Sheets

(58) Field of Classification Search
CPC ..... A47L 15/449; D06F 39/02; D06F 39/022; D06F 39/024; D06F 33/02; D06F 38/028
USPC ... 134/56 D, 93, 57 D, 99.2, 58 D, 25.2, 18, 134/56 R, 94.1, 115 R, 57 R, 58 R, 100.1, 134/26, 29; 68/17 R, 207, 12.18, 12.02, 68/13 R, 213; 222/651, 129, 52, 1, 504, 222/325, 333, 54, 652
See application file for complete search history.

(56) References Cited

U.S. PATENT DOCUMENTS

| | | | | |
|---|---|---|---|---|
| 6,453,917 | B1 | 9/2002 | Biechele | |
| 6,923,191 | B2 * | 8/2005 | Cerruti | A47L 15/4409 134/93 |
| 7,047,987 | B2 * | 5/2006 | Cerruti | A47L 15/4409 134/58 D |
| 8,382,913 | B2 * | 2/2013 | Classen | A47L 15/4454 134/58 D |
| 8,631,972 | B2 * | 1/2014 | Kessler | A47L 15/006 134/99.2 |
| 2002/0153029 | A1 * | 10/2002 | Cerruti | A47L 15/4409 134/29 |
| 2004/0020517 | A1 * | 2/2004 | Cerruti | A47L 15/4409 134/25.2 |
| 2005/0150260 | A1 | 7/2005 | Marone et al. | |
| 2006/0151544 | A1 * | 7/2006 | Greenwald | B67D 1/0079 222/333 |
| 2010/0132748 | A1 * | 6/2010 | Kessler | A47L 15/4454 134/93 |
| 2011/0139816 | A1 * | 6/2011 | Kessler | A47L 15/4454 134/93 |
| 2011/0174344 | A1 * | 7/2011 | Cerruti | A47L 15/44 134/115 R |
| 2011/0204096 | A1 * | 8/2011 | Kessler | A47L 15/4454 222/129 |

FOREIGN PATENT DOCUMENTS

| | | | | |
|---|---|---|---|---|
| DE | 100 24 014 | A1 | 1/2001 | |
| DE | 10 2004 059 137 | A1 | 7/2005 | |
| DE | 10 2006 024 152 | A1 | 11/2007 | |
| EP | 1943937 | A1 * | 7/2008 | A47L 15/4257 |
| JP | 58-20689 | U | 2/1983 | |

OTHER PUBLICATIONS

Italian Search Report issued in IT201600084226 dated May 24, 2017.

* cited by examiner

DOSING DEVICE FOR DISPENSING A WASHING AGENT IN A WASHING MACHINE, IN PARTICULAR A DISH WASHING MACHINE

BACKGROUND OF THE INVENTION

Field of the Invention

The present invention concerns a dosing device for dispensing doses of a washing agent, in particular a rinsing agent, towards the washing chamber of a washing machine, such as a dishwashing machine.

Background

A dosing device of this type is known from the German patent DE 100 24 014 C2.

SUMMARY OF THE INVENTION

An object of the present invention is to provide an alternative dosing device to the one forming the object of that patent and having a relatively simple structure and a reliable operation.

This and other objects are accomplished according to the invention with a dosing device the salient features of which are defined herein.

The dependent claims define further advantageous optional aspects of a dosing device according to the present invention.

BRIEF DESCRIPTION OF THE DRAWINGS

Further features and advantages of the invention will be apparent from the following detailed description, provided purely by way of non-limiting example, with reference to the accompanying drawings, wherein.

DETAILED DESCRIPTION OF THE INVENTION

Figure 1:
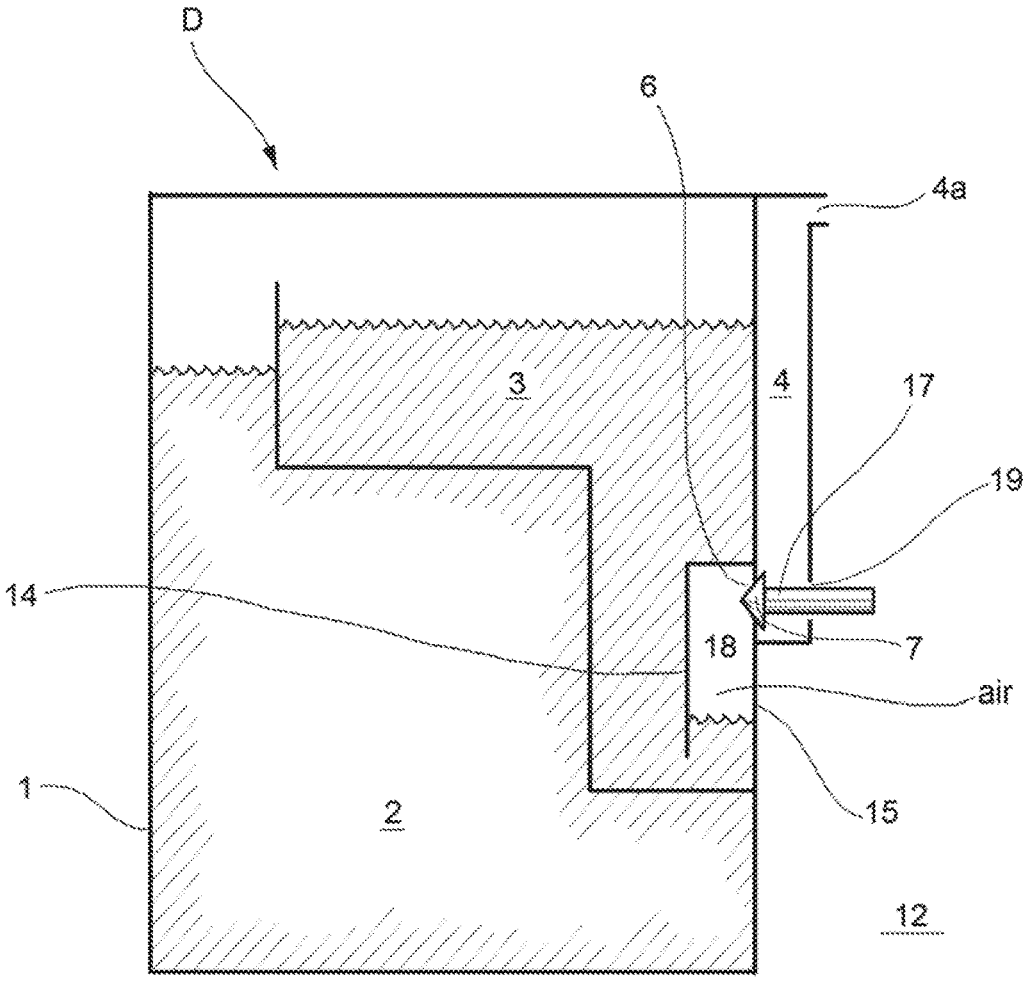
FIGS. 1 to 5 are schematic sectional views showing a dosing device according to the present invention in the working position, in successive operating conditions.

In the drawings, a dosing device according to the present invention is collectively indicated at D. Such dosing device D comprises a body 1, for example of molded plastic material, typically intended to be mounted in the wall of the front door of a dishwashing machine facing the washing chamber.

Such door is oscillatable around a horizontal axis, near its lower side, between an essentially vertical working position wherein it closes the washing chamber, and an at least approximately horizontal position wherein it allows access to the washing chamber for unloading the washed dishes and/or loading dishes to be washed.

When the dishwashing machine door is open, the dispensing device D assumes a loading position, not shown in the drawings, wherein it is rotated approximately 90° counterclockwise with respect to the working position shown in the drawings.

In the body is defined a main chamber 2 adapted to contain an amount of said washing agent corresponding to a plurality of doses.

Inside the body 1, adjacent to the main chamber 2, an auxiliary chamber 3 is defined, also adapted to contain a quantity of washing agent corresponding to a multiplicity of doses. It is considered more convenient that the volume of the auxiliary chamber 3 corresponds to a number of doses lower than the number of doses that the main chamber 2 is likely to contain.

Inside the body 1 is further defined a dosing chamber, indicated at 4 in the drawings.

Such chamber has a volume substantially corresponding to approximately a single dose of washing agent to be dispensed at each washing cycle of the dishwashing machine.

The dosing chamber 4 has a vent opening 4*a* above, and a dispensing opening indicated at 19 below.

In the body 1, between the auxiliary chamber 3 and the dosing chamber 4, is defined an intermediate chamber indicated at 18 in the drawings.

The intermediate chamber 18 in the illustrated embodiment is delimited laterally and superiorly with respect to the auxiliary chamber 3 by a wall 14. Said intermediate chamber 18 is closed superiorly, while inferiorly it communicates permanently with the auxiliary chamber 3.

Between the upper part of the intermediate chamber 18 and the dosing chamber 4 is defined a communication passage, indicated at 6 in the drawings.

Such communication passage is associated with an obturator 7 mounted movable in the dosing chamber 4 and carried, for example, by a rod 17, the position of which is controllable, in a known and therefore not illustrated manner, by means of an electrically controlled actuator, such as a solenoid actuator.

The communication passage 6 is made in a wall 15 that delimits the intermediate chamber 18 facing the wall 14.

Figure 2:
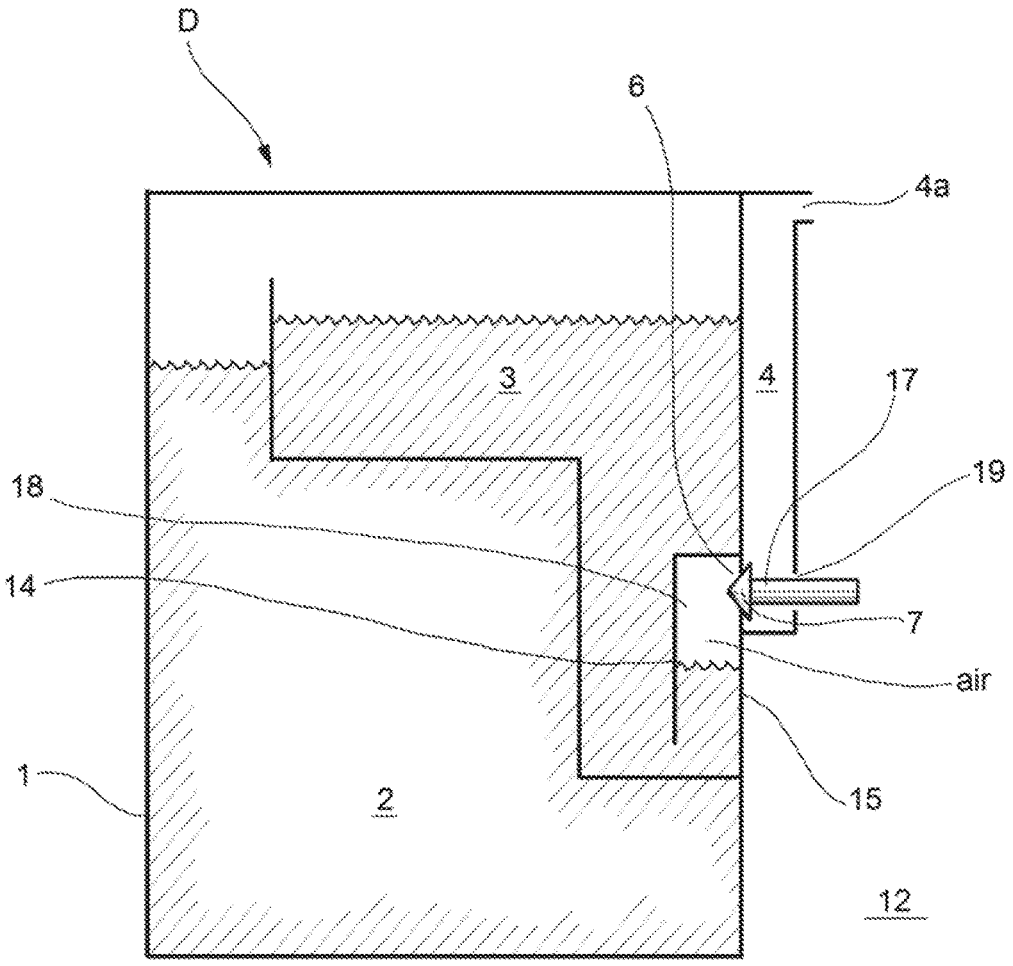

The obturator 7 normally assumes a first position, shown in FIGS. 1 and 2, wherein it closes the communication passage 6 between the intermediate chamber 18 and the dosing chamber 4, while simultaneously freeing the dispensing opening 19 of the dosing chamber 4.

In operation, the electrically controlled actuator associated with the valve obturator 7 in each wash cycle is energized a first time with a very short pulse for the actuation of another function.

It is in fact typical that a washing agent dispensing device (rinsing agent) is integrated into a combined dispensing device which also includes a detergent dispenser, for example a powder or a compressed detergent.

In such a case, the relatively short first pulse is intended to allow the same actuator that controls the obturator 7 of the dosing device D to cause the activation of the associated detergent dispensing device.

In such a configuration, it is desirable that when the dispensing of the detergent is caused, the rinsing agent is not dispensed at the same time.

Therefore, the relatively short drive impulse applied to the actuator that also controls the obturator 7 must be such that it does not cause the dispensing of rinsing agent to the washing chamber, which is indicated at 12 in the drawings.

At each wash cycle, after the relatively short first pulse, the actuator associated with the obturator 7 is then energized a second time, with a longer pulse, to properly activate the dosing device D for dispensing a dose of rinsing agent to the washing chamber 12.

When, prior to performing a washing cycle, the door of the dishwashing machine wherein the dosing device D is mounted is brought to the substantially horizontal opening position, the washing agent contained in the auxiliary chamber 3 of the dosing device flows towards the main chamber 2, and the intermediate chamber 18 also discharges to the auxiliary chamber 3 the small amount of rinsing agent contained therein.

When, in the view of starting a washing cycle, the door of the dishwashing machine is brought back to the vertical working position, the auxiliary chamber 3 retains a quantity of rinsing agent corresponding to a plurality of doses, while at the top of the intermediate chamber 18 is trapped in an amount or "bubble" of air, as shown in FIG. 1, while a small amount of washing or rinsing agent fills the lower part of this intermediate chamber 18 below this air bubble, as may be seen in FIG. 1. This figure shows the dosing device D in the operating condition assumed when the door of the dishwashing machine is closed and the actuator associated with the valve obturator 7 has not yet been energized, whereby such obturator separates via a fluid-tight seal the intermediate chamber 18 from the dosing chamber 4, which is completely open.

Subsequently, during a wash cycle, when a first short excitation pulse is applied to the actuator associated with the valve obturator 7, the obturator 7 briefly opens the communication passage 6 between the intermediate chamber 18 and the dosing chamber 4: during the brief opening time, a part of the air bubble contained in the upper part of the intermediate chamber 18 is discharged into the dosing chamber 4 and is then evacuated through the vent opening 4*a* of the latter.

As soon as said first short excitation pulse is lost, the obturator 7 closes the communication passage 6 and the dosing device D then has the configuration shown in FIG. 2 of the appended drawings: the amount of air contained in the upper part of the intermediate chamber 18 has decreased while the level of the rinsing agent in the lower part of such intermediate chamber has risen. It should be noted, however, that until such condition is reached, no quantity or dose of washing or rinsing agent is received in the dosing chamber 4.

Figure 3:
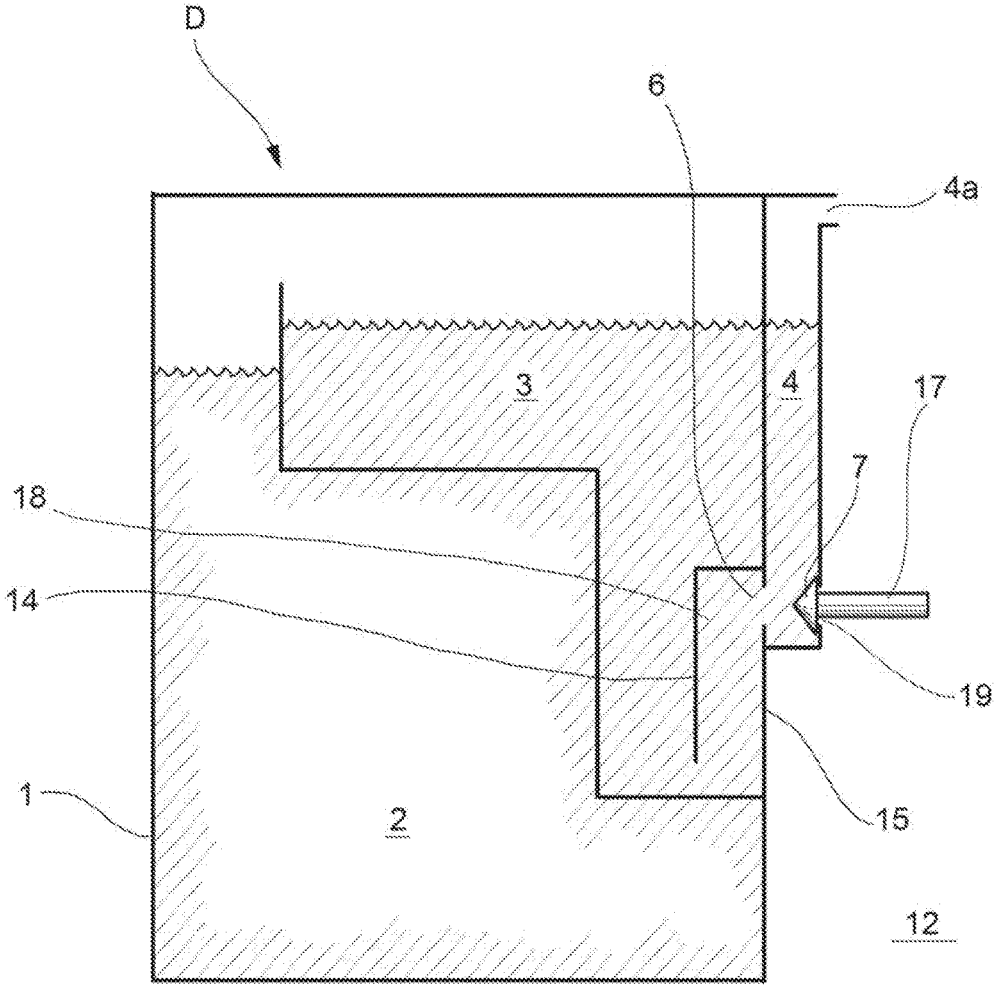

When subsequently, during the washing cycle, a second relatively long excitation pulse is applied to the actuator associated with the valve obturator 7, the dosing device D assumes the configuration shown in FIG. 3: the obturator 7 frees the communication passage 6 between the intermediate chamber 18 and the dosing chamber 4, and closes the dispensing opening 19 in a fluid-tight seal. In such condition, the residual air bubble that was still trapped in the intermediate chamber 18 is completely discharged into the dosing chamber 4 and is evacuated therefrom through the vent opening 4*a*. Furthermore, into the dosing chamber 4 is emitted a washing or rinsing agent that reaches therein the same level as the auxiliary chamber 3.

Figure 4:
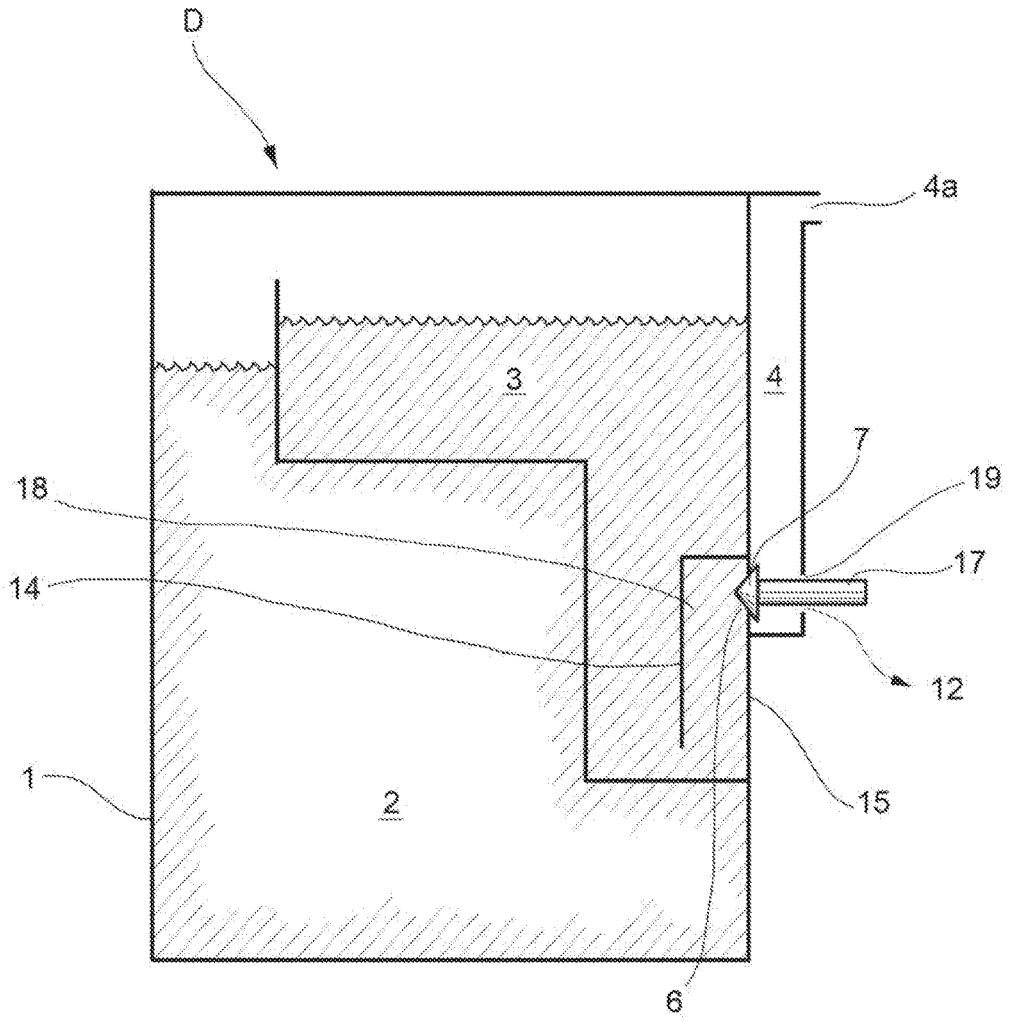

When said second excitation pulse for the actuator associated with the obturator 7 is exhausted, the dosing device D assumes the configuration shown in FIG. 4: the obturator 7 again closes the communication passage 6 between the intermediate chamber 18 and the dosing chamber 4, and opens the dispensing opening 19 through which the dose of rinsing agent previously introduced into the dosing chamber 4 may flow into the washing chamber 12 of the machine. The intermediate chamber 18 is in such condition substantially full of washing or rinsing agent.

When, at the end of the wash cycle, the door of the dishwashing machine is opened again, the washing or rinsing agent contained in the intermediate chamber 18 and in the auxiliary chamber 3 pours out by gravity into the main chamber 2. The intermediate chamber 18 then completely empties, and is ready to trap a new air bubble at the next closing of the door of the dishwashing machine.

Figure 5:
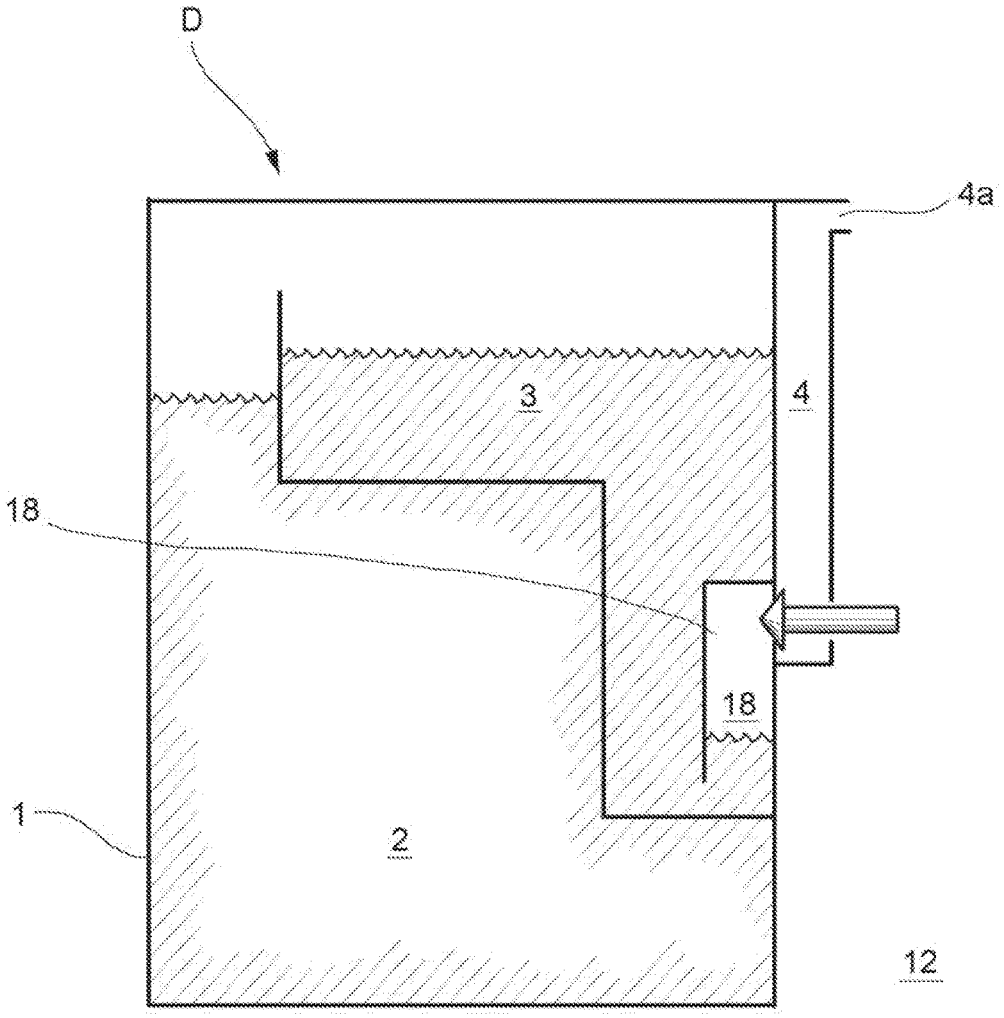

After the door of the dishwashing machine has been closed, the dosing device D appears in the condition shown in FIG. 5. This condition is entirely analogous to that shown in FIG. 1, from which it differs essentially in that the level of the washing or rinsing agent in the main chamber 2 and in the auxiliary chamber 3 is now slightly lower.

As already indicated above, the dosing device according to the present invention represents a valid alternative to the solution described in the aforementioned German patent and is characterized by a relatively simple structure and very reliable operation.

Naturally, without altering the principle of the invention, the embodiments and the details of implementation may vary widely with respect to those described and illustrated purely by way of non-limiting example, without thereby departing from the scope of the invention as defined in the appended claims.

What is claimed is:

1. A dosing device for dispensing doses of a washing agent, towards a washing chamber of a washing machine, comprising:

a hollow body oscillatable between a loading position and a vertical, operating position, and in which there are defined:

a main chamber adapted to contain an amount of said washing agent corresponding to a plurality of doses, and a dosing chamber adapted to contain a volume of washing agent substantially corresponding to one dose, coming from the main chamber; and an electrically controlled valve obturator driven in each cycle of operation of the machine by a first short pulse for the actuation of another function, and thereafter with a subsequent second long pulse in order to put the dosing chamber in communication with the main chamber and thereafter cause the dispensing of a dose of washing agent from the dosing chamber towards the washing chamber, wherein in the hollow body there are further defined:

an auxiliary chamber adapted to contain an amount of said washing agent corresponding to a multiplicity of doses, and an intermediate chamber comprising an upper end and a lower end, the intermediate chamber being disposed between the auxiliary chamber and the dosing chamber, and communicating permanently with the auxiliary chamber at the lower end of the intermediate chamber, wherein a communication passage is defined between the intermediate chamber and the dosing chamber, wherein the dosing chamber comprises a dispensing opening, and wherein said valve obturator is movable in the dosing chamber between a position opening, and a second position in which the valve obturator opens said communication passage and closes said dispensing opening, wherein the communication passage is located at the upper end of the intermediate chamber, under a top wall delimiting the upper end of the intermediate chamber, wherein the intermediate chamber is adapted to:

trap an air bubble when said hollow body oscillates from the loading position to the vertical, operating position, and discharge a washing agent contained therein towards said auxiliary chamber when the hollow body oscillates from the vertical, operating position to the loading position, and wherein said valve obturator controls the communication between the intermediate chamber and the dosing chamber such that said first pulse causes the intermediate chamber to be put in communication with the dosing chamber for a short time, causing a partial discharge of said air bubble from the intermediate chamber to the dosing chamber and a corresponding increase of the amount of washing agent contained in the intermediate chamber, and said second pulse causes the intermediate chamber to be put in communication with the dosing chamber for a relatively longer time, sufficient to allow the storing of a dose of washing agent in the dosing chamber and, when said second pulse is over, the dispensing of said dose of washing agent stored in the dosing chamber.

2. The dosing device according to claim 1, wherein the auxiliary chamber is adapted to contain an amount of washing agent corresponding to a multiplicity of doses, the number of which is less than the number of doses which the main chamber can contain.

3. The dosing device according to claim 1, wherein the dosing chamber comprises an upper end and a lower end, said communication passage and dispensing opening being located at the lower end of the dosing chamber.

4. The dosing device according to claim 3, wherein the dosing chamber comprises a vent opening located at the upper end of the dosing chamber.

5. The dosing device according to claim 1, wherein the auxiliary chamber comprises an upper end and a lower end, said auxiliary chamber communicating permanently with the intermediate chamber at the lower end of the auxiliary chamber.

6. The dosing device according to claim 5, wherein the auxiliary chamber communicates permanently with the main chamber at the upper end of the auxiliary chamber.

* * * * *